United States Patent [19]

Jennings, Jr.

[11] Patent Number: 4,617,997

[45] Date of Patent: Oct. 21, 1986

[54] FOAM ENHANCEMENT OF CONTROLLED PULSE FRACTURING

[75] Inventor: Alfred R. Jennings, Jr., Plano, Tex.

[73] Assignee: Mobil Oil Corporation, New York, N.Y.

[21] Appl. No.: 769,226

[22] Filed: Aug. 26, 1985

[51] Int. Cl.[4] ..... E21B 43/263

[52] U.S. Cl. ..... 166/299; 166/308

[58] Field of Search ..... 166/299, 308, 309, 300

[56] References Cited

U.S. PATENT DOCUMENTS

| | | | |
|---|---|---|---|
| 3,101,115 | 8/1963 | Riordan, Jr. | 166/309 |
| 3,136,361 | 6/1964 | Marx | 166/308 |
| 3,273,643 | 9/1966 | Billings et al. | 166/45 |
| 3,486,560 | 12/1969 | Hutchinson et al. | 166/309 |
| 3,561,532 | 2/1971 | Fletcher et al. | 166/299 |
| 3,659,652 | 5/1972 | Roberts | 166/308 |
| 3,747,679 | 7/1973 | Roberts | 166/299 |
| 3,893,511 | 7/1975 | Root | 166/309 |
| 4,039,030 | 8/1977 | Godfrey et al. | 166/299 |
| 4,415,805 | 11/1983 | Fertl et al. | 250/260 |
| 4,548,252 | 10/1985 | Stowe et al. | 166/308 |

*Primary Examiner*—Stephen J. Novosad
*Assistant Examiner*—Bruce M. Kisliuk
*Attorney, Agent, or Firm*—Alexander J. McKillop; Michael G. Gilman; Charles A. Malone

[57] ABSTRACT

The effectiveness of controlled pulse fracturing treatment ("CPF") is enhanced by creating a foam when energy is released from the pulse device. Foam created by a foaming agent in the wellbore fluid increases said fluid's apparent viscosity and controls fluid loss. The increased viscosity causes additional fracture propagation. Upon commencement of production of hydrocarbonaceous fluids, fines and debris resultant from CPF are transported from the fractures which cleans up the well.

24 Claims, 3 Drawing Figures

FIG. 1
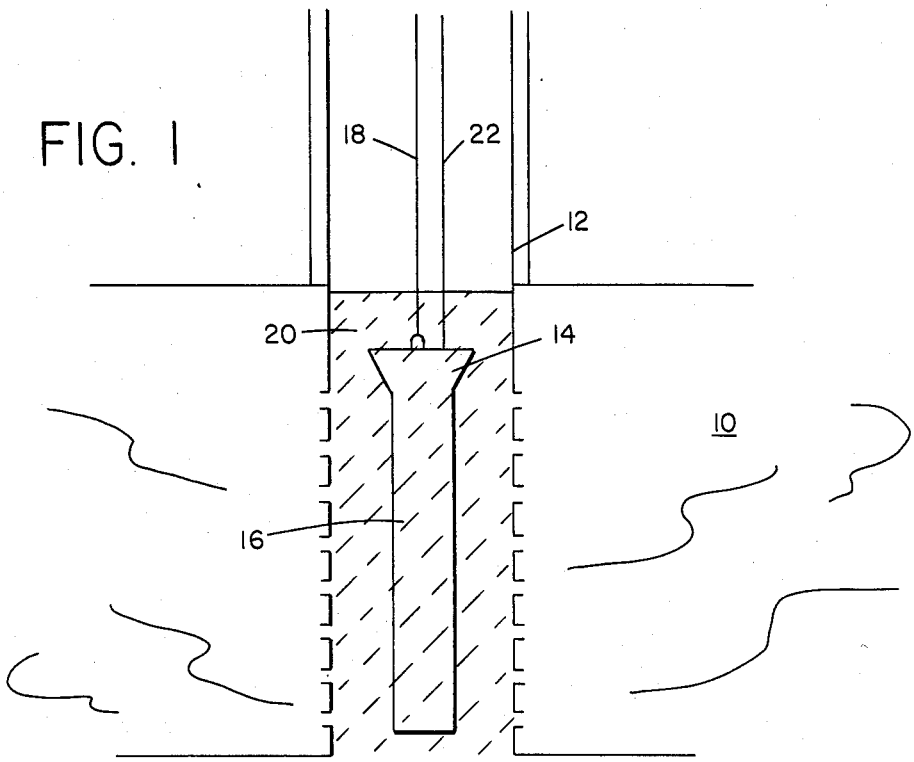
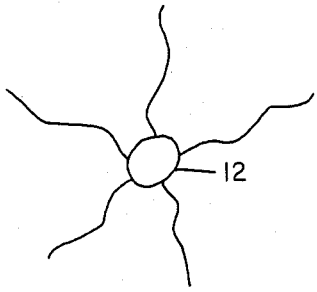
FIG. 2
FIG. 3
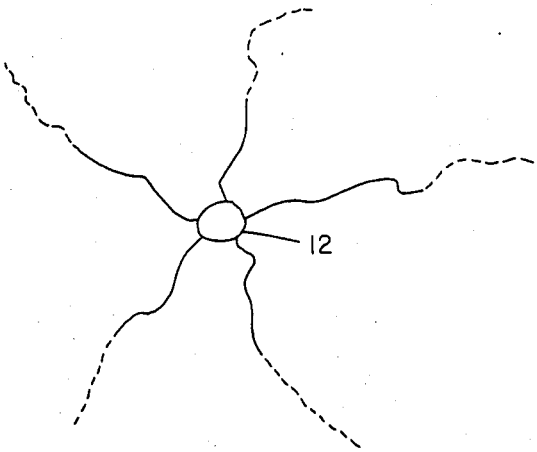

FOAM ENHANCEMENT OF CONTROLLED PULSE FRACTURING

FIELD OF THE INVENTION

This invention is directed to a method for extending radial fractures obtained by controlled pulse fracturing in combination with foam in underground formations or reservoirs.

BACKGROUND OF THE INVENTION

It has been known for some time that the yield of hydrocarbons, such as gas and petroleum, from wells can be increased by fracturing the formation so as to stimulate the flow of hydrocarbons in the well. Various formation fracturing procedures have been proposed and many now are in use. Among these procedures are treatments with various chemicals (usually acids in aqueous solutions), hydraulic fracturing in which liquids are injected under high pressure (usually with propping agents), explosive methods in which explosives are detonated within the formations to effect mechanical fracture, and combinations of the above procedures.

Chemical treatments usually involve the use of large volumes of chemicals which can be expensive and difficult to handle, and which pose problems of contamination and disposal. Hydraulic fracturing ordinarily requires that large volumes of liquids be made available at the well site and that equipment be made available for handling these large volumes of liquid. Again, there can be disposal problems, when load fluid is produced back to the surface. Explosive methods can be exceptionally hazardous from the standpoint of transporting and using the necessary explosives. These methods also present difficulties in controlling the effects of such a procedure.

Other suggestions for increasing the yield of existing wells entail heating the formation to induce the flow of hydrocarbons from the formation. Methods and apparatus have been developed by which various combustion devices have been lowered into the borehole of a well to attain heating of the formation adjacent the device. The effectiveness of such devices is limited by the necessity for fitting the devices into a borehole and then obtaining only more-or-less localized effects.

A combustion method designed to stimulate the well through mechanical fracture is known as controlled pulse fracturing or high energy gas fracturing. A good description of this method appears in an article by Cuderman, J. F., entitled "High Energy Gas Fracturing Development," Sandia National Laboratories, SAND 83-2137, October 1983. Using this method enables the multiple fracturing of a formation or reservoir in a radial manner which increases the possibility of contacting a natural fracture. Unfortunately, these radial fractures often do not penetrate deeply enough into the formation. Often, in unconsolidated formations, fines cause the fractures to become blocked. Therefore, a method is needed which will extend the fractures deeper into the formation and aid in the removal of fines from the fractures.

SUMMARY OF THE INVENTION

This invention is a combination of a controlled pulse radial fracturing method and an in situ foam generation method for creating and extending fractures in a subterranean formation or reservoir. Foam which is generated by the wellbore fluid increases the fluid's apparent viscosity and controls fluid loss. The increased viscosity of said fluid causes additional fracture propagation. Upon commencement of production of hydrocarbonaceous fluids, any resultant fines and debris are transported from the fractures via said foam which serves to clean up pores in the formation and the well.

In the practice of this invention, a subterranean formation is penetrated by at least one well which extends from the surface of the earth into a formation. Thereafter, said well is filled above the productive interval with a fluid containing a foaming agent which is sufficient to cause foam to be generated for entry into induced fractures. Next, suspended in said well within said fluid and near the productive interval, is a propellant means for fracturing said formation by a pressure loading rate sufficient to create multiple fractures. Upon ignition, said propellant means creates gases, heat, and a pressure loading rate sufficient to create multiple fractures and cause said foaming agent to foam. Subsequently, said propellant means is ignited whereby said foaming agent foams and the foam enters into the multiple fractures created by said pressure loading rate. This peak pressure load is maintained sufficiently above the in-situ stress pressure but below the rock yield stress for a time sufficient to allow foam generation, fluid penetration and extension of said fractures.

It is an object of this invention to create multiple radial fractures, near the wellbore and extend those fractures into the formation via the simultaneous generation of foam.

It is yet another object of this invention to avoid damaging rock near the wellbore when creating multiple fractures.

It is still another object of this invention to create multiple fractures, generate gases and pressure sufficient to cause a foam to form and extend said multiple fractures.

It is a further object of this invention to extend said multiple fractures into the formation for a distance sufficient to contact at least one natural hydrocarbonaceous producing fracture.

It is a still further object of this invention to obtain increased quantities of hydrocarbonaceous fluids.

It is a yet further object of this present invention to increase the productivity of damaged wells by multiple induced fractures.

It is a still yet further object of this invention to remove fines and debris from the formation and wellbore via said foam which removal increased the production of hydrocarbonaceous fluids.

BRIEF DESCRIPTION OF THE DRAWINGS

FIG. 1 is a cross sectional schematic view of an embodiment of this invention.

FIG. 2 illustrates a plan view of fractures resultant from controlled pulse fracturing.

FIG. 3 shows a plan view of controlled pulse fractures which have been extended by foam.

DESCRIPTION OF THE PREFERRED EMBODIMENTS

In the preferred embodiment of this invention, it is desired to create multiple radial fractures in the formation via the wellbore or borehole and extend the fractures with foam generated in situ without crushing the wellbore or borehole. It is desired to create multiple extended radial fractures to enhance the possibility for recovering hydrocarbons by intersecting a natural hydrocarbonaceous fluid producing fracture.

Referring to FIG. 1, a foaming agent is mixed with an aqueous fluid and placed into the wellbore fluid 20 which level lies above the productive interval of the formation. Foaming agents which can work in this invention are disclosed by Root in U.S. Pat. No. 3,893,511 issued July 8, 1975 and which is hereby incorporated by reference. Other foaming agents which can work in the practice of this invention are disclosed by Billings et al. in U.S. Pat. No. 3,273,643 issued Sept. 20, 1966 and which is hereby incorporated by reference.

Examples of foaming agents which can work include: polyoxyethylated alkyl phenols such as Triton X-102 and Triton X-165 marked by Rohm and Haas Company; alkyl aryl polyethylene glycol ether detergent such as Igepals marketed by General Aniline and Film Corporation; reaction products of ethylene oxide with fatty acid amides marketed as Ethomid by Armour and Company; condensation products of ethylene oxide with a propylene oxide-propylene glycol reaction product marketed as Pluronics by Wyandotte Chemical Corporation are typical non-ionic surface active agents which may be used. In general, non-ionic foaming agents are preferred since they have substantially no tendency to react with subterranean brines. However, anionic surface agents such as Triton QS-15 or cationic surface active agents such as the Arquads marked by Armour and Company may be used. Licorice extracts and protein hydrolyzates may also be used. Of course, may other foaming agents may be used, e.g., those disclosed on pages 12 and 13 of United States Bureau of Mines Monograph 11 entitled, "Using Foaming Agents to Remove Liquids From Gas Wells," by Dunning, Eakin and Walker, the disclosure of which is incorporated herein by reference.

In practice, enough foaming agent should be introduced into the well to produce a strong foam. In general, a concentration of at least about 0.01% to about 1% have been found to be satisfactory. The foaming agent may be diluted with water, brine, or organic solvents for introduction into the wellbore or borehole. Proportions of foaming agent and solvent may be varied within a broad range, so long as the viscosity of the mixture is kept low enough to enable it to flow readily into the reservoir. In general, the solvent may vary from 10 to 90%, with a range of 50 to 70% being preferred in many cases. Alcohol has been found to be a convenient organic solvent. It has also been found desirable in many cases to first introduce the solution of foaming agent into the wellbore or borehole and then wash it down with water.

Gas and pressure required to initiate the foam is obtained from a propellant which is in canister 16. Canister 16 is affixed to retainer stem 14 which is attached to retrieval cable 18. Electrical conduit 22 enters retainer stem 14 where it connects with a means for igniting the propellant in canister 16. Retrieval cable 18 and electrical conduit 22 are affixed to a holding means (not shown) which is located above and outside wellbore 12. Upon igniting the propellant in canister 16, heat, gas and pressure enter the wellbore fluid 20, containing the foaming agent, and cause a foam to form which enters the formation 10 through the radial multiple fractures which are generated.

Upon entry into formation 10, the foam extends the multiple radial fractures which are generated. This is accomplished because of the increase in the apparent viscosity of the wellbore fluid caused by the foaming action. An increase in the apparent viscosity allows the foam to enter into the fractures with increased pressure. This causes said fractures to be extended further than previously obtainable by the wellbore fluid alone.

When the pressure decreases and the foam collapses, the decreased viscosity of the wellbore fluid causes any resultant fluid and debris which has accumulated in the fractures to return into the wellbore. Removal of any resultant fines and debris allows the permeability of the formation to be retained. This leads to greater production of hydrocarbonaceous fluids.

FIG. 2 shows a plan view of fractures resultant from controlled pulse fracturing in the absence of the generated foam. FIG. 3 illustrates a plan view of fractures resultant from controlled pulse fracturing in combination with the foam.

The propellant in the canister can belong to the modified nitrocellulose or the modified and unmodified nitroamine propellant class. Suitable solid propellants capable of being utilized include a double-based propellant known as N-5. It contains nitroglycerine and nitrocellulose. Another suitable propellant is a composite propellant which contains ammonium perchlorate in a rubberized binder. The composite propellant is known as HXP-100 and is purchasable from the Holex Corporation of Hollister, Calif. N-5 and HXP-100 propellants are disclosed in U.S. Pat. No. 4,039,030 issued to Godfrey et al. which is hereby incorporated by reference.

An N-5 solid propellant was utilized by C. F. Cuderman in an article entitled "High Energy Gas Fracturing Development," Sandia National Laboratories, SAND 83-2137, October 1983. This article is also incorporated by reference. High energy gas fracturing or controlled pulse fracturing is a method used for inducing radical fractures around a wellbore or borehole. Via this method a solid propellant-based means for fracturing is employed along with a propellant composed to permit the control of pressure loading sufficient to produce multiple fractures in a borehole at the oil or hydrocarbonaceous fluid productive interval. A peak pressure is generated which is substantially above the in-situ stress pressure but below the rock yield stress pressure.

As previously stated, ignition of the propellant means for creating the multiple fractures causes the generation of heat and gas pressure. As is known to those skilled in the art, the amount of heat and pressure produced is dependent upon the kind of propellant used, its grain size and geometry. Heat and pressure generation also depends upon the burning rate, weight of charge and the volume of gases generated.

Subsequently, the heat and pressure are maintained for a time sufficient to allow fluid penetration and extension of fractures. As is known, heat generation and pressure maintenance are dependent upon the nature of the formation and the depth it is desired to extend the fractures into the formation. After the heat and pressure have been maintained for a time sufficient to promote the desired fracturing, the heat and pressure dissipate into the formation surrounding the wellbore.

After the pressure has dissipated and it is determined that a natural oil producing fracture has not been intercepted or contacted by the extended radial fractures, an explosive slurry can be injected into the fractures created in the formation. This slurry should be placed into the formation at a depth or distance substantially away from the wellbore, so as to avoid damaging it. Once this has been accomplished, the explosive slurry is detonated. Pressures created by the detonation of the slurry will cause additional fracturing of the foam extended radial fractures. Explosive slurries which will work in the practice of this invention are known to those skilled in the art.

The effectiveness of fracturing at each stage of this method can be determined by available methods. One such method is described in U.S. Pat. No. 4,415,805 issued to Fertl et al. This patent is incorporated herein by reference. In this method a multiple stage formation fracturing operation is conducted with separate radioactive tracer elements injected into the well during each stage of the fracturing operation. After completion of the fracturing operation, the well is logged using natural gamma ray logging. The resulting signals are sorted into individual channels or energy bands characteristic of each separate radioactive tracer element. Results of the multiple stage fracturing operation are evaluated based on dispersement of the individual tracer elements.

In another embodiment of this invention, the location and direction of at least one natural hydrocarbonaceous fluid fracture is determined. This determination can be made by geologists and others skilled in the art. After the general location and direction of the natural fracture is determined, the well or wellbore is notched in a manner sufficient to direct pressure induced in the well in the direction of the natural fracture. Notching can be accomplished by methods known to those skilled in the art. One preferred method is the use of hydraulic pressure to cut notches into or near the hydrocarbonaceous production interval of the well. Another method which can be employed is the use of explosive projectiles. These projectiles can be fired into the well or wellbore wall at desired levels to create the desired notches.

After notching the well, a means for fracturing the formation by a pressure loading rate sufficient to create multiple fractures is placed into the well or wellbore substantially near the hydrocarbonaceous productive interval. Later, the in-situ stress pressures are determined. In-situ stress pressures are those pressures which occur naturally in an earth formation from hydraulic and heat sources. In-situ stress pressures are less than the pressures required to fracture rock in the formation.

As mentioned above, a propellant means for creating multiple fractures is placed in the well or wellbore substantially near the hydrocarbonaceous fluid productive interval and ignited. As is known to those skilled in the art, the pressure loading rate is the primary parameter for the production of multiple fractures. The loading rate required to produce multiple fractures is an inverse function of wellbore or borehole diameter. Hot gases are formed in the wellbore or borehole upon ignition of the propellant means creating a pressure. Gas pressurization of the cracks formed plays an important role during fracturing by inhibiting the formation of new cracks, and increasing the length of the existing cracks. As is known to those skilled in the art, the number and length of cracks is reduced when the rock yield stress is exceeded. When the rock yield stress is not exceeded by use of excessive wellbore peak pressure, the length of the longest cracks is increased.

After reaching the peak pressure load, it is maintained sufficiently above the in-situ stress pressure but below the rock yield stress pressure for a time sufficient to allow foam penetration and extension of fractures.

If a natural hydrocarbonaceous fracture has not been intersected, an explosive slurry can be pumped into the formation and detonated to create additional fracturing. Explosives which can be used are similar to those mentioned above.

Each step of this method can be repeated until at least one natural hydrocarbonaceous fracture has been intercepted or connected. Also, the order of the steps can be reversed for maximum fracturing effectiveness.

These embodiments are a combination of known methods for fracturing subterranean formations or reservoirs. As is known by those skilled in the art, neither method alone is adequate to connect or intersect natural hydrocarbonaceous fluid producing fractures located substantial distances from the wellbore. Combining the controlled pulse fracturing method in combination with foam injection alone or in combination with explosive slurry injection produces enlarged and extended fractures. These enlarged and extended fractures can contain larger volumes of foam or explosive slurry. Larger volumes of foam or explosive slurry, properly utilized, can cause the generation of greater fracturing pressures than previously believed possible.

Although the present invention has been described with preferred embodiments, it is to be understood that modifications and variations may be resorted to without departing from the spirit and scope of this invention, as those skilled in the art will readily understand. Such modifications and variations are considered to be within the purview and scope of the appended claims.

I claim:

1. A method for fracturing a subterranean formation penetrated by at least one well which extends from the surface of the earth to the formation comprising:

(a) filling said well above the productive interval with a fluid containing a foaming agent sufficient to cause foam to be generated for entry into induced fractures;

(b) placing into said well within said fluid and near the productive interval a propellant means for fracturing said formation by a pressure loading rate sufficient to create multiple fractures and which upon ignition creates gases, heat, and a pressure loading rate sufficient to create multiple fractures and cause said foaming agent to foam;

(c) igniting said proepllant whereby said foaming agent foams and the foam enters into the multiple fractures created by said pressure loading rate; and (d) maintaining the peak pressure load sufficiently above the in-situ stress pressure but below the rock yield stress for a time sufficient to allow foam generation, fluid penetration and extension of said fractures.

2. The method as recited in claim 1 where in step (a) said foaming agent is a member selected from the group consisting of nonionic, anionic, and cationic active agents.

3. The method as recited in claim 2 where in step (a) said foaming agent comprises from about 0.01 to about 1.0 weight percent of the fluid within the wellbore.

4. The method as recited in claim 1 where in step (b) the means for fracturing comprises a modified nitrocellulose propellant.

5. The method as recited in claim 1 where in step (b) the means for fracturing comprises a modified nitroamine propellant.

6. The method as recited in claim 1 where in step (b) the means for fracturing comprises an unmodified propellant.

7. The method as recited in claim 1 where in step (b) the means for fracturing comprises a nitroglycerine and nitrocellulose double-based propellant.

8. The method as recited in claim 1 where in step (b) the means for fracturing comprises an ammonium perchlorate composite propellant with a rubberized binder.

9. The method as recited in claim 1 where after step (c) an explosive slurry is pumped into the expanded fractures and detonated creating a force sufficient to further extend the fractures.

10. The method as recited in claim 1 where after step (c) an explosive slurry is pumped into the expanded fractures, the slurry is detonated creating a force sufficient to further extend the fractures, and this procedure is repeated until at least one natural hydrocarbonaceous fluid fracture is intersected.

11. The method as recited in claim 1 where before step (c) an explosive slurry is pumped into the expanded fractures and detonated creating a force sufficient to further extend the fractures.

12. The method as recited in claim 1 where before step (c) an explosive slurry is pumped into the expanded fractures, the slurry is detonated creating a force sufficient to further extend the fractures, and this procedure is repeated until at least one natural hydrocarbonaceous fluid producing fracture is intersected.

13. A method for fracturing a subterranean formation penetrated by at least one well which extends from the surface of the earth to the formation comprising:

(a) determining the direction of at least one natural hydrocarbonaceous fluid producing fracture substantially near the well;

(b) notching the well in a manner sufficient to direct induced pressure in the direction of the natural fracture;

(c) filling said well above the productive interval with a fluid containing a foaming agent sufficient to cause foam to be generated for entry into induced fractures;

(d) placing into said well within said fluid and near the productive interval a propellant means for fracturing said formation by a pressure loading rate sufficient to create multiple fractures and which upon ignition creates gases, heat, and a pressure loading rate sufficient to create multiple fractures and cause said foaming agent to foam;

(e) igniting said propellant whereby said foaming agent foams and the foam enters into the multiple fractures created by said pressure loading rate; and (f) maintaining the peak pressure load sufficiently above the in-situ stress pressure but below the rock yield stress for a time sufficient to allow foam generation, fluid penetration and extension of said fractures.

14. The method as recited in claim 13 where in step (c) said foaming agent is a member selected from the group consisting of nonionic, anionic, and cationic active agents.

15. The method as recited in claim 2 where in step (c) said foaming agent comprises from about 0.01 to about 1.0 weight percent of the fluid within the wellbore.

16. The method as recited in claim 1 where in step (d) the means for fracturing comprises a modified nitrocellulose propellant.

17. The method as recited in claim 1 where in step (d) the means for fracturing comprises a modified nitroamine propellant.

18. The method as recited in claim 1 where in step (d) the means for fracturing comprises am unmodified propellant.

19. The method as recited in claim 1 where in step (d) the means for fracturing comprises a nitroglycerine and nitrocellulose double-based propellant.

20. The method as recited in claim 1 where in step (d) the means for fracturing comprises an ammonium perchlorate composite propellant with a rubberized binder.

21. The method as recited in claim 1 where after step (e) an explosive slurry is pumped into the expanded fractures and detonated creating a force sufficient to further extend the fractures.

22. The method as recited in claim 1 where after step (e) an explosive slurry is pumped into the expanded fractures, the slurry is detonated creating a force sufficient to further extend the fractures, and this procedure is repeated until at least one natural hydrocarbonaceous fluid fracture is intersected.

23. The method as recited in claim 1 where before step (e) an explosive slurry is pumped into the expanded fractures and detonated creating a force sufficient to further extend the fractures.

24. The method as recited in claim 1 where before step (e) an explosive slurry is pumped into the expanded fractures, the slurry is detonated creating a force sufficient to further extend the fractures, and this procedure is repeated until at least one natural hydrocarbonaceous fluid producing fracture is intersected.

* * * * *